US005479674A

United States Patent [19]

Gilcrest

[11] Patent Number: 5,479,674

[45] Date of Patent: Jan. 2, 1996

[54] GOLF-SHOE CLEANING APPARATUS FOR ATTACHING TO A GOLF BAG

[76] Inventor: Richard J. Gilcrest, 1730 Halford Ave., #147, Santa Clara, Calif. 95051

[21] Appl. No.: 267,659

[22] Filed: Jun. 29, 1994

[51] Int. Cl.[6] ..... A47L 23/00; A63B 55/08

[52] U.S. Cl. ..... 15/161; 15/160; 273/32 B

[58] Field of Search ..... 15/160, 161, 215, 15/217; 206/315.3; 273/32 B

[56] References Cited

U.S. PATENT DOCUMENTS

| | | | |
|---|---|---|---|
| 1,479,644 | 1/1924 | Browne | 15/161 X |
| 3,028,617 | 4/1962 | Racina | 15/160 |
| 3,142,853 | 8/1964 | Hensley | 15/160 |
| 4,571,767 | 2/1986 | Dangler | 15/161 |
| 4,733,424 | 3/1988 | Gurkin | 15/161 |

FOREIGN PATENT DOCUMENTS

| | | | |
|---|---|---|---|
| 2232580 | 12/1990 | United Kingdom | 15/161 |

*Primary Examiner*—Edward L. Roberts, Jr.

*Attorney, Agent, or Firm*—Michael J. Hughes; Bradley T. Sako

[57] ABSTRACT

A golf shoe cleaner 10 is provided for attachment to a golf bag base 20. A brush 12 having an array of bristles 34 thereon, is removably attached to a brush retainer 14. The brush retainer 14 is hingedly attached to an attachment bracket 16. The brush retainer 14, with the brush 12 therein, swings between a "use" and "store" position. The store position is characterized by the vertical or near vertical position of the brush retainer 14 where the brush retainer 14 is secured in place by a pair of opposing spring bracket bullet catches (78 and 80) on the attachment bracket 16. The use position is characterized by the horizontal, or near horizontal orientation of the brush retainer 14.

18 Claims, 4 Drawing Sheets

GOLF-SHOE CLEANING APPARATUS FOR ATTACHING TO A GOLF BAG

TECHNICAL FIELD

This invention relates generally to golfing equipment, and more specifically to golf shoe cleaning attachments for golf bags.

BACKGROUND ART

The game of golf requires players to address a golf ball in a variety of terrains. The variety of terrain found on a given golf course is one of the great attractions of the game. With the added effects of weather and seasons, which can soften or harden a given surface, the golfer can be faced with any number of surfaces in only a single game. Occasionally, surfaces can hamper a game, particularly if the player's shoes lack sufficient traction. While traction is important when traversing a golf course, it can be critical when addressing the golf ball. Bad traction can ruin a game of golf and even result in injury. The need for traction has long since given rise to a variety of golf shoes aimed at improving traction.

Golf shoes are typically characterized by a number of spikes extending from the soles of the shoes. When the shoes are in use, these spikes occasionally become fouled with turf, mud or other items, resulting in a reduction, or in rare cases, a complete loss of traction. Fouled golf shoes can also be quite messy. A pair of dirty shoes can quickly soil a trunk, locker or car interior.

A variety of devices have been created to clean golf shoes. Among these devices is a golf shoe cleat cleaner shown in U.S. Pat. No. 3,028,617 issued to Joseph L. Racina on Apr. 10, 1962. The Racina patent teaches a brush attachment to a golf bag cart. The attachment has two portions that pivot between a vertical and horizontal position. This arrangement requires some effort to use, however. Due to the mobility of the cart, the handle must be gripped to keep it from moving when it is used. The pivoting design of the '617 patent has some drawbacks as well. First, it requires the loosening of a wing nut to pivot one portion with respect to the other. Second, the brush rests on a single, narrow section. This can be unstable if the brush is contacted on the edge of the brush. In the event the brush must be removed, two screws must be unscrewed and then screwed back into the new brush. This can be time consuming and frustrating if the brush requires changing at an inopportune moment, such as in the middle of a golf game.

U.S. Pat. No. 4,571,767 issued to Charles C. Dangler on Feb. 25, 1986 presents a golf shoe cleaner having a brush mounted on the end of a tubular shaft. The drawback of the '767 shoe cleaner is that it is designed to be transported within a golf bag, and so would soil the golf bag. The cleaner is also rather large and conspicuous.

A third invention, U.S. Pat. No. 5,077,858 issued to John C. Lewis, Jr. on Jan. 7, 1992 sets forth a mat-like arrangement that is placed on the ground. The mat-like structure can be tiring to use as it requires continuous stooping to deploy and then pick up the mat.

Various commercial devices, such as brushes with spike cleaning attachments and stand-up devices where a player may clean spikes by moving the feet are common. Spike cleaners on tees, and at the entrance to buildings on golf course grounds are also popular.

While the cited and commercial prior art provides a number of solutions to cleaning golf shoes, none of the prior art provides a golf shoe cleaner that addresses the above mentioned needs and overcomes the drawbacks of the prior art.

SUMMARY OF THE INVENTION

Accordingly, it is an object of the present invention to provide a golf shoe cleaner that is easy to use.

It is another object of the present invention to provide a golf shoe cleaner that attaches to a golf bag.

It is yet another object of the present invention to provide a golf shoe cleaner that can be stored in a discreet, non-use position.

It is another object of the present invention to provide a golf shoe cleaner with a brush that is quickly and easily removed.

Briefly, the preferred embodiment of the present invention is a golf shoe cleaner that attaches to the base of a golf bag. The shoe cleaner includes a brush block having a removable brush with an array of bristles, an attachment bracket fixed to the base of the golf bag, and a hinge, pivotally connecting the brush block to the attachment bracket. The brush pivots within the attachment bracket between a "use" and "store" position. In the use position the brush block is oriented in a horizontal, or near horizontal position, with the array of bristles facing upward. In the store position, the brush block is oriented in a vertical, or near vertical position, with the array of bristles facing the side of the golf bag.

In the preferred embodiment, the bracket member includes a pair of opposing bullet springs for engaging the brush block, and holding it in the store position. A small force applied to the block releases it from the bullet springs and allows it to be pivoted into the use position. Once the golfer is finished using the golf shoe cleaner, the brush block is rotated back into the store position where it is held in place by the bullet springs. In the preferred embodiment, the brush block is moved between the use and store position with the foot.

An advantage of the present invention is that it provides a handy golf shoe cleaner with a secure storage orientation.

Another advantage of the present invention is that it provides a golf shoe cleaner with a compact storage orientation.

Another advantage of the present invention is that it is intuitively easy to use.

Another advantage of the present invention is that it requires minimal physical effort to deploy.

Another advantage of the present invention is that it requires minimal physical effort to store.

Yet another advantage of the present invention is that it provides a golf shoe cleaner of stable construction.

Still another advantage of the present invention is that is provides a golf shoe cleaner with a brush that is easily removable.

BEST MODE OF CARRYING OUT THE INVENTION

Figure 1:
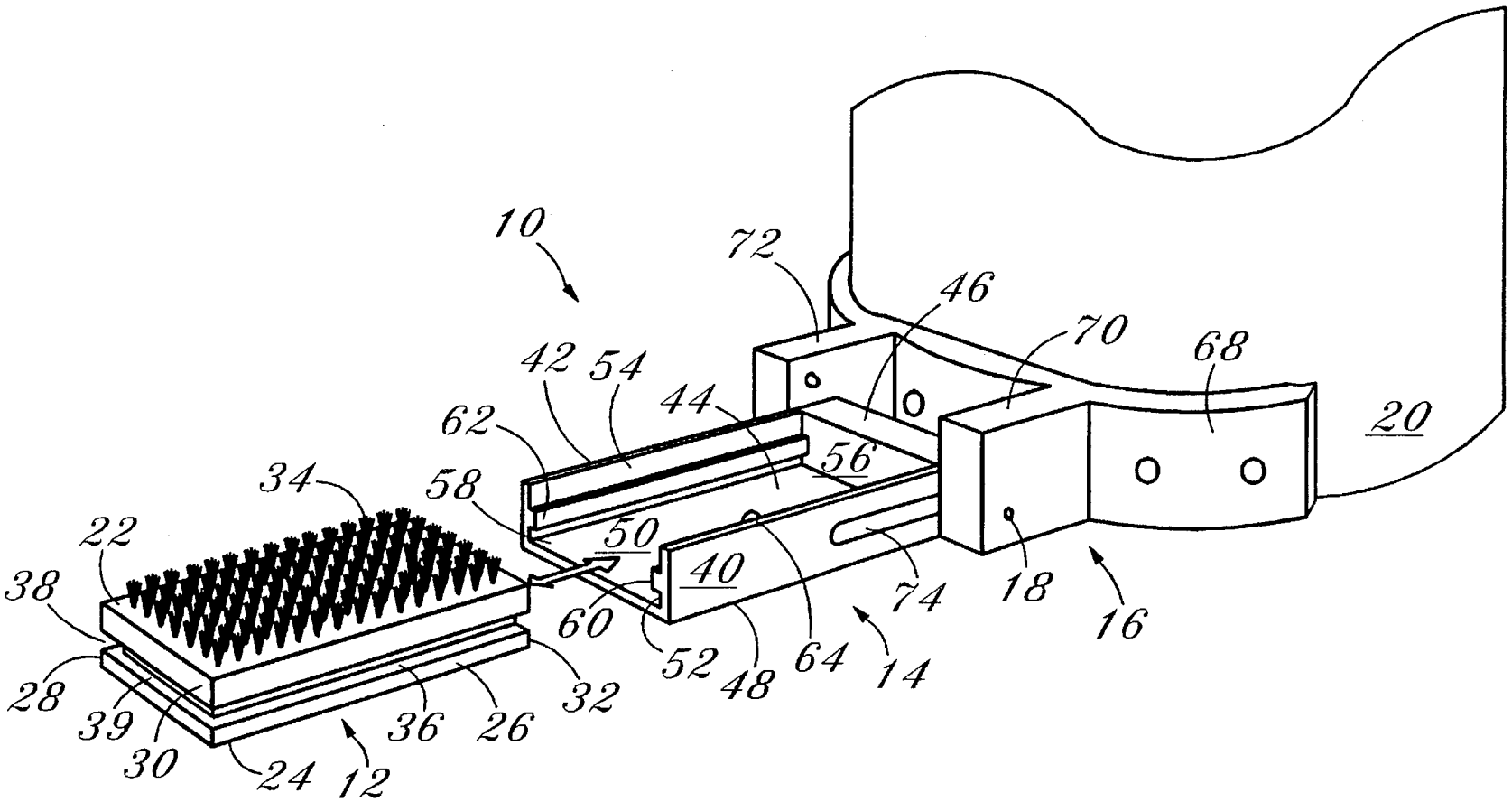
FIG. 1 is a perspective view of the preferred embodiment deployed in the use position.

The best presently known mode for carrying out the invention is a compact, easy to use golf shoe cleaner that is attached to a golf bag. Referring now to FIG. 1, the preferred embodiment of the present invention is set forth in an exploded perspective view, and designated by the general reference character 10. The golf shoe cleaner 10 includes a brush 12, a brush retainer 14, and an attachment bracket 16. As shown by the directional arrows, the brush 12 slides into a brush retainer 14 which is shaped to receive the brush 12. The brush retainer 14 is pivotally attached to the attachment bracket 16 by way of a hinge 18. The attachment bracket in turn, is attached to a golf bag base 20.

The brush 12 has a generally rectangular block shape that includes a top surface 22, a bottom surface 24, a first side 26, a second side 28, a first end 30 and a second end 32. As shown in FIG. 1, the top surface 22 contains an array of bristles 34 projecting in an upward direction. Set within the first side surface 26 is a first channel 36. In a similar manner, the second side surface 28 has a second channel 38 and the first end 30 has an end channel 39. In the preferred embodiment 10, the first and second channels (36 and 38) have a square cross sectional aspect (although other shapes may also be selected), and run the entire length of their respective sides surfaces (26 and 28).

In the preferred embodiment 10, the brush retainer 14 includes a first outer wall 40, a second outer wall 42, a brush receiving slot 44, a rear block portion 46, and a retainer floor 48. The brush receiving slot 44 has a flat slot bottom 50, a first slot side 52, a second slot side 54 opposite the first slot side, a slot end 56, and a slot opening 58 opposite the slot end 56. As set forth in FIG. 1, the first slot side 52, second slot side 54, and slot end 56 extend upward, perpendicular to the slot bottom 50. The opposing first slot side 52 and second slot side 54 have a corresponding first ridge 60 and second ridge 62, respectively. Each ridge (60 and 62) runs the entire length of the respective slot sides side (52 and 54), and has a square cross sectional aspect, slightly smaller than the cross sectional aspect of the channels (36 and 38) set into the brush side surfaces (26 and 28). If other aspects are selected for the channels (36 and 38) the corresponding relation will be maintained for the mating ridges (52 and 54).

Figure 2:
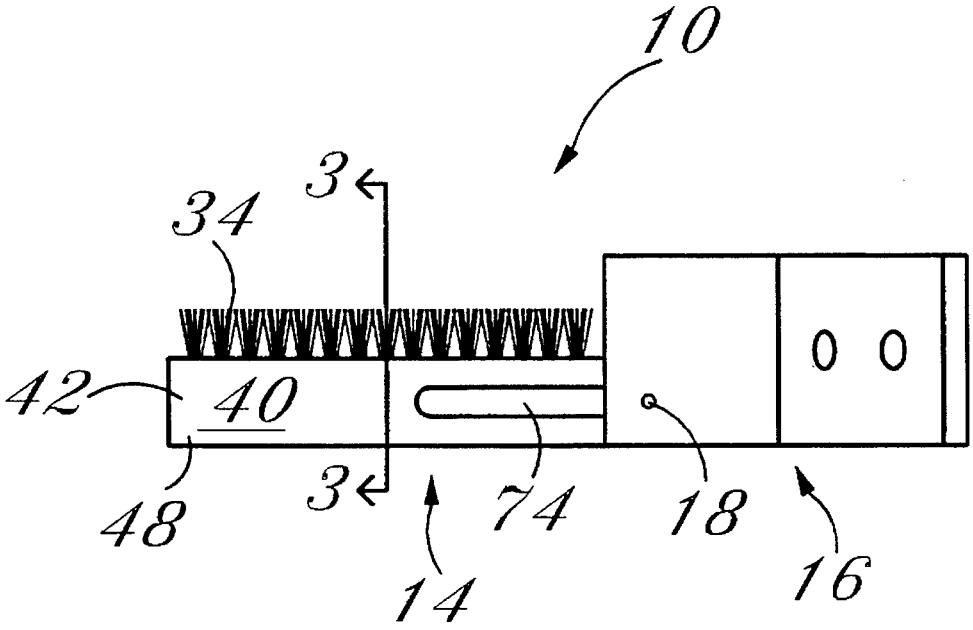
FIG. 2 is a side elevational view of the preferred embodiment in the use position.

As mentioned previously, the brush retainer 14 is designed to mate with the brush 12. In the preferred embodiment 10, the brush 12 is slid into the slot 44 of the brush receiver 14 so that the channels (36 and 38) within the brush side surfaces (26 and 28) mate with the ridges (60 and 62) of the slot sides (52 and 54). FIG. 2 is a side elevational view of the preferred embodiment 10, with the brush 12 fully inserted into the brush retainer 14. It is noted that the brush 12 can be slid into the slot 44 either first end 30 or second end 32 first. This provides a unique advantage in prolonging the effectiveness of the array of bristles 34. The constant scraping action of shoes on the array of bristles 34 can tend to deform the array of bristles 34 in a single direction, which eventually renders the array of bristles 34 ineffective. By occasionally reversing the direction of the brush 12 within the slot 44, the array of bristles 34 are scraped in opposing directions, minimizing deformation and prolonging the effectiveness of the array of bristles 34.

Figure 3:
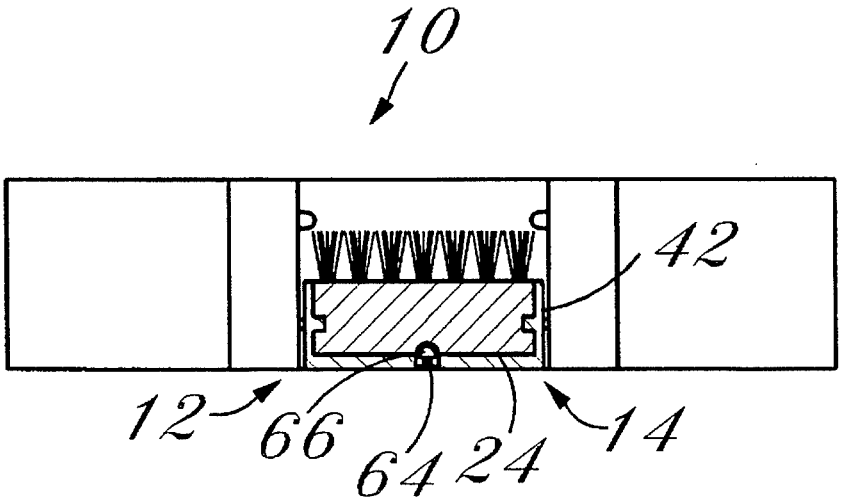
FIG. 3 is a front cross sectional view of the preferred embodiment in the use position taken along line 3—3 of FIG. 2.

As shown in FIG. 1, a spring-loaded retainer bullet catch 64 projects upward from the retainer floor 48 of the brush retainer 14. The retainer bullet catch 64 aids in securing the brush 12 to the brush retainer 14. FIG. 3 is a cross sectional view of the preferred embodiment 10 with the brush 12 fully inserted into the brush retainer 14. As is illustrated in FIG. 3, when the brush 12 is fully inserted into the brush retainer 14 the retainer bullet catch 64 projects into a catch cavity 66 set into in the brush bottom surface 24. When the brush 12 is slid into or out of the brush retainer 14 the retainer bullet catch 64 is forced downward and out of the catch cavity 66. The retainer bullet catch 64 helps keep the brush 12 secure in the brush retainer 14 by the additional force required to push the retainer bullet catch 64 out of the catch cavity 66. The bullet shape of the retainer bullet catch 64 facilitates the insertion and removal of the brush 12.

The removable nature of the brush 12 has the additional advantage of enabling the golfer to clean other items in addition to shoes. Once slid out of the brush retainer 14 the brush 12 can be held in the hand and used to hand clean the sides of shoes, golf clubs, the golf bag itself, or any other item. The brush 12 is then easily reinserted into the brush retainer 14.

While the preferred embodiment 10 sets forth a particularly shaped brush 12 and brush retainer 14, one skilled in the art would recognize that the brush 12 shape could vary widely provided it sufficiently interlocks with the brush retainer 14. The inventive shoe cleaner 10 does not require both the retainer bullet catch 64 and shape mating arrangement of the brush 12 and brush retainer 14 to function. The shoe cleaner 10 could rely solely on a friction fit between the brush 12 and brush retainer 14, or only one or more retainer bullet catches 64. One skilled in the art would also recognize that the brush 12 is not limited to employing an array of bristles 34. A plurality of upwardly projecting plastic spikes could be used in place of the array of bristles 34. The type of material on the top surface 22 of the brush 12 could vary greatly depending on the type of shoe used and terrain anticipated.

As shown in FIG. 1, the brush retainer 14 is connected to the attachment bracket 16 by the hinge 18. The attachment bracket 16 includes a curved attachment member 68, a forwardly projecting first hinge arm 70, and a forwardly projecting second hinge arm 72. The hinge 18 runs from the first hinge arm 70 through the rear block portion 46 of the brush retainer 14, and into a second hinge arm 72. The hinge 18 allows the brush retainer 14 to pivot with respect to the attachment bracket 16 between a "use" position and "store" position. The use position is illustrated in FIG. 2 and is characterized by a generally horizontal orientation of the brush retainer 14. In the use position the array of bristles 34 faces upward and the retainer floor 48 contacts the ground and extends away from the golf bag base 20. In the use position the brush 12 is presented for cleaning. The golfer moves his/her shoes across the array of bristles 34 to clean the bottom of the shoes. Because the brush retainer 14 contacts the ground over a wide area, the golfer can apply a large amount of pressure on the brush 12 without disturbing the golf bag.

While the preferred embodiment of the present invention 10 incorporates a particular type of hinge 18, the invention is not limited to that described. It is understood that one skilled in the art could incorporate a variety of hinge designs. A number of hinge arms could be placed on the brush retainer 14 that interlock with one or more attachment bracket hinge arms (70 and 72). The hinge 18 could be sunk into the golf bag base 20 so that the brush retainer 14 is flush with the golf bag in the store position.

Figure 4:
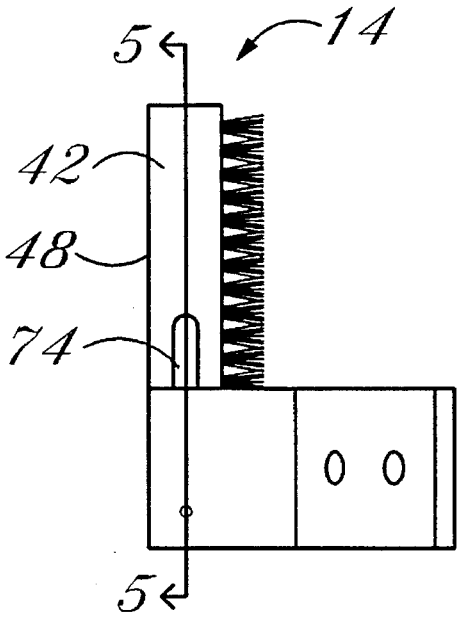
FIG. 4 is a side elevational view of the preferred embodiment in the store position.

The store position of the preferred embodiment be 10 is illustrated by FIG. 4 and characterized by a generally vertical orientation of the brush retainer 14. In the store position, the brush retainer 14 is positioned with the retainer floor 48 facing outward and the array of bristles 34 situated adjacent to the golf bag. In the preferred embodiment 10 the shape of the brush retainer 14 assists in securing the brush retainer 14 in the store position. As shown in FIGS. 1, 2 and 4, and best illustrated in the cross sectional view of FIG. 5, the first outer wall 40 of the brush retainer 14 has an inset first catch groove 74. The second outer wall 42 of the brush retainer 14 includes a second catch groove 76 identically shaped to the first catch groove 74.

Figure 5:
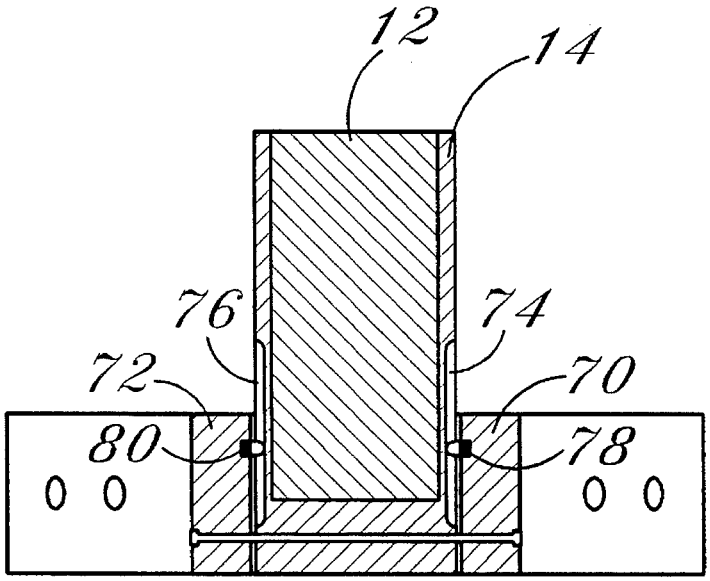
FIG. 5 is a front cross sectional view of the preferred embodiment in the store position taken along line 5—5 of FIG. 4.

As illustrated in FIG. 5, in the store position the two catch grooves (74 and 76) receive a spring-loaded first bracket bullet catch 78 and second bracket bullet catch 80. The first bracket bullet catch 78 is set into the first hinge arm 70, above the hinge 18. Likewise, the second bracket bullet catch 80 is set within the second hinge arm 72 above the hinge 18. To place the shoe cleaner 10 in the store position the brush retainer 14 is pivoted upward until the first bracket bullet catch 78 and second bracket bullet catch 80 engage the first catch groove 74 and second catch groove 76, respectively. In this position the brush retainer 14 is secured in the store position. The bracket bullet catches (78 and 80), like the retainer bullet catch 64, have curved shapes to facilitate the engagement and disengagement of the catch grooves (74 and 76).

While the preferred embodiment 10 utilizes a retainer bullet catch 64 and two bracket bullet catches (78 and 80), one skilled in the art would recognize a number of different catch designs would work as well. The hinge 18 could be pretensioned in the use position, and the attachment bracket 16 equipped with a single releasable catch such that when the catch is activated the brush retainer 14 automatically flips from the store to the use position. Other variations could include different catch types. The attachment bracket 16 could include one or more releasable pawls that engage steps on the brush retainer 14.

Figure 6:
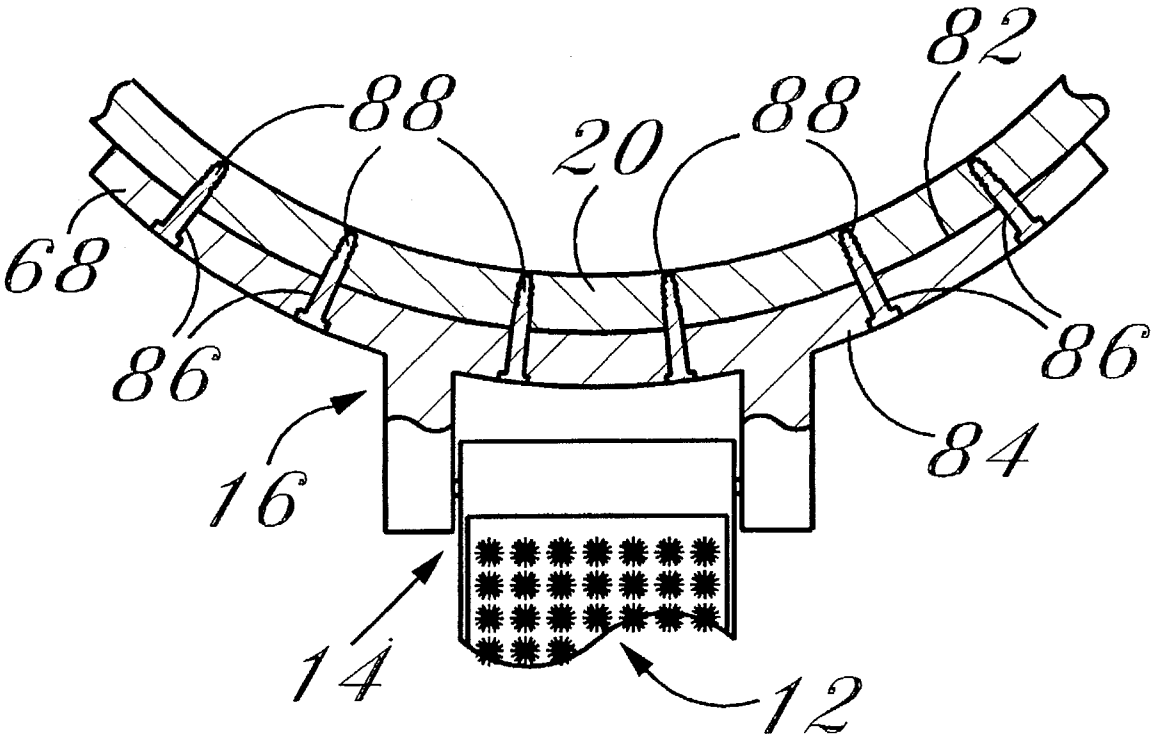
FIG. 6 is a top view of the preferred embodiment showing a partial cross sectional view of the attachment bracket.

FIG. 6 is top view setting forth a cross sectional view of the attachment bracket 16 and golf bag base 20, illustrating the preferred method used to attach the attachment bracket 16 to the golf bag base 20. The curved attachment member 68 conforms to the golf bag base 20 and includes an attachment face 82, an outer face 84 and a number of attachment apertures 86. An attachment screw 88 corresponding to each attachment aperture 86 extends through the curved attachment member 68 and is anchored in the golf bag base 20, securing the golf shoe cleaner 10 to the golf bag base 20.

While the preferred embodiment 10 sets forth a screw-aperture arrangement to fix the attachment bracket 16 to the golf bag base 20, it would obvious to one skilled in the art that a number of alternate attachment methods could also be employed. The attachment bracket 16 could include a strap that tightens around the golf bag base 20. Alternatively, the golf shoe cleaner 10 could include a "shoe" portion that surrounds and frictionally engages the entire golf bag base 20. Glues or epoxies could be used to attach the attachment bracket 16 to the golf bag base 20, with appropriate attention directed to the materials involved when choosing the glue or epoxy. The golf bag base 20 could also be preformed to include the attachment bracket 16 as an integral portion thereof.

In addition to the above mentioned examples, various other modifications and alterations of the dimensions, materials, orientation and usages may be made without departing from the invention. Accordingly, the above disclosure is not to be considered as limiting and the appended claims are to be interpreted as encompassing the entire spirit and scope of the invention.

INDUSTRIAL APPLICABILITY

The predominant current usages of the present invention is as a golf shoe cleaner 10 that is attached to the base of the golf bag 20. The curved attachment member 68 is shaped to conform with, and attach to, existing golf bag bases 20. A number of attachment screws 88 can be driven through the attachment bracket 16 into the golf bag base 20. It is anticipated that the golf shoe cleaner 10 will be available in color schemes that match or compliment the golf bag it is attached to. The brush 12, brush retainer 14, and attachment bracket 16 of the preferred embodiment 10 are molded from high impact plastic which can be colored to the desired hue, or covered with an appropriately colored material. The hinge 18, retainer bullet catch 64 and bracket bullet catches (78 and 80) are constructed of metal, but can be covered or painted, if desired.

The preferred embodiment 10 is particularly adaptable to those free standing golf bags that incorporate a number of legs. Once the bag is standing the golf shoe cleaner 10 can be deployed in the use position and shoe soles cleaned by simply wiping the shoes on the brush 12. For those bags which are not free standing, the bag can be held upright as the golf shoe cleaner 10 is deployed and used. It is noted that the golf bag does not move as the shoe cleaner 10 is used because the brush retainer 14 contacts the ground which receives all of the downward force from the shoes.

The golf shoe cleaner of the preferred embodiment 10 is intended to be an integral part of the typical golfer's equipment. Prior to departing on the course, the golf shoe cleaner 10 is placed in the store position. When the golfer's golf shoes accumulate too much turf/mud etc., the golfer deploys the golf shoe cleaner 10 with the foot, by swinging the brush retainer 14 so that it overcomes the engaging bracket bullet catches (78 and 80) and swings into the use position. The end channel 39 provides a convenient structure for the golfing spikes to engage when deploying the shoe cleaner. The golfer can then drag the fouled golf shoes across the array of bristles 34 until the shoe is cleaned. If a different part of the golf shoe, or some other item, requires cleaning, the brush 12 can be removed from the brush retainer 14, used by hand, and then returned into the brush retainer 14. Once all of the desired cleaning is accomplished, a simple lifting motion of the foot returns the brush retainer 14 back to the store position. Once the array of bristles 34 has been used over time, and begins to be deformed in one direction, the brush 12 can be rotated within the brush retainer 14 as described above.

A variety of brushes 12 can be provided covering a range bristle densities and flexibility. These brushes 12 can be interchanged as desired. A single brush can be inserted before departing on the course, or a number of different brushes can be carried in the golf bag and used during the game.

Since the golf shoe cleaner 10 of the present invention is easy to use, provides a compact storage arrangement, may be readily constructed and quickly attached to existing golf bags, it is expected that the utility and industrial applicability of the invention will be both significant in scope and long-lasting in duration.

I claim:

1. A cleaning device for golf shoes for attachment to a golf bag having a base and a side, comprising:

a retaining member having two opposing side surfaces and a top surface;

a cleaning element retained by said retaining member;

a bracket secured by attachment means to the base of said golf bag;

hinge means, hingedly connecting said retaining member to said bracket, such that said retaining member pivots between a store position, roughly parallel to the side of said golf bag, and a use position, wherein said cleaning element faces upward; and releasable locking means for securing said retaining member in the store position.

2. The cleaning device of claim 1 wherein:

said cleaning element includes an array of bristles.

3. The cleaning device of claim 1 wherein:

said cleaning element includes a plurality of stiff projections.

4. The cleaning device of claim 1 wherein:

said bracket includes two hinge arms; and said retaining member is connected by said hinge means to said bracket between the two hinge arms.

5. The cleaning device of claim 1 wherein:

said retaining member includes catch detents formed on the opposing side surfaces of said retaining member; and said releasable locking means includes two opposing spring bullet catches situated on said bracket so as to engage the catch detents in the store position.

6. The cleaning device of claim 1 wherein:

the attachment means of said bracket includes a plurality of screws extending through said bracket into the bag of said golf bag.

7. The cleaning device of claim 1 wherein:

the attachment means of said bracket includes an adjustable strap.

8. The cleaning device of claim 1 wherein:

said cleaning element is detachably attached to said retaining member.

9. The cleaning device of claim 8 wherein:

said retaining member includes a spring bullet catch; and said cleaning element includes a catch detent for engaging the spring bullet catch.

10. The cleaning device of claim 8 wherein:

said cleaning element includes a removable brush.

11. The cleaning device of claim 8 wherein:

said retaining member includes a slot; and said cleaning element is adapted to fit into the slot.

12. The cleaning device of claim 1 wherein:

the attachment means of said bracket includes preforming said bracket such that said bracket is an integral part of the golf bag base.

13. A golf bag base attachment for cleaning golf shoes, comprising:

a bracket attached to the golf bag base, said bracket including catch means; and a rigid sole cleaning member having a first end and a second end, the first end being pivotally attached to said bracket such that said sole cleaning member pivots between a store position, where said sole cleaning member is engaged by the catch means, and a use position, where the second end of said sole cleaning member extends away from the golf bag base.

14. The golf bag attachment of claim 13 wherein:

said sole cleaning member includes a cleaning element and a receiving channel adapted to mate with the cleaning element.

15. The golf bag attachment of claim 14 wherein:

the receiving channel includes catch means for engaging the cleaning element.

16. The golf bag attachment of claim 14 wherein:

the cleaning element is a brush.

17. The golf bag attachment of claim 14 wherein:

the cleaning element includes a first side, and a second side opposite the first side, each side having a straight groove, the receiving channel including a pair of opposing ridges for slidingly engaging the grooves when the cleaning element mates with the receiving channel.

18. The golf bag attachment of claim 14 wherein:

said sole cleaning member includes two, parallel opposing sides, each side having a groove; and the catch means of said bracket includes a pair of opposing bullet springs, the bullet springs springingly engaging the grooves of said sole cleaning member in the store position.

* * * * *